US006134329A

United States Patent [19]

Gao et al.

[11] Patent Number: 6,134,329

[45] Date of Patent: Oct. 17, 2000

[54] METHOD OF MEASURING AND PREVENTING UNSTABLE FEEDBACK IN HEARING AIDS

[75] Inventors: Shawn X. Gao, Cerritos; Sigfrid D. Soli, Sierra Madre, both of Calif.

[73] Assignee: House Ear Institute, Los Angeles, Calif.

[21] Appl. No.: 08/926,320

[22] Filed: Sep. 5, 1997

[51] Int. Cl.[7] ..... H04R 29/00

[52] U.S. Cl. ..... 381/60; 381/312; 381/321

[58] Field of Search ..... 381/313, 320, 381/328, 60, 56, 58, 321, 318, 317, 98, 107, 316, 93; 73/585

[56] References Cited

U.S. PATENT DOCUMENTS

| | | |
|---|---|---|
| Re. 34,961 | 6/1995 | Widin et al. . |
| 4,471,171 | 9/1984 | Köpke et al. . |
| 4,548,082 | 10/1985 | Engebretson et al. . |
| 4,577,641 | 3/1986 | Hochmair et al. . |
| 4,586,194 | 4/1986 | Kohashi et al. . |
| 4,637,402 | 1/1987 | Adelman . |
| 4,809,708 | 3/1989 | Geisler et al. . |
| 4,879,749 | 11/1989 | Levitt et al. . |
| 4,953,112 | 8/1990 | Widin et al. . |
| 4,966,160 | 10/1990 | Birck et al. . |
| 4,992,966 | 2/1991 | Widin et al. . |
| 5,016,280 | 5/1991 | Engebretson et al. . |
| 5,027,410 | 6/1991 | Williamson et al. . |
| 5,091,952 | 2/1992 | Williamson et al. . |
| 5,105,822 | 4/1992 | Stevens et al. . |
| 5,259,033 | 11/1993 | Goodings et al. . |
| 5,276,739 | 1/1994 | Krokstad et al. . |
| 5,325,436 | 6/1994 | Soli et al. . |
| 5,386,475 | 1/1995 | Birck et al. . |
| 5,577,511 | 11/1996 | Killion . |
| 5,594,174 | 1/1997 | Keefe . |

*Primary Examiner*—Vivian Chang
*Attorney, Agent, or Firm*—Blakely, Sokoloff, Taylor & Zafman LLP

[57] ABSTRACT

A "true" hearing aid transfer function, including feedback, is derived from measurements taken with the hearing aid fitted in a patient's ear canal. Closed loop transfer functions are calculated at several hearing aid gains without opening the internal circuitry of the hearing aid using a time domain Weiner optimal filter model. The combined open loop transfer function of the hearing aid and feedback path is then calculated. Once the open loop transfer function is known, potentially unstable frequencies are identified and maximum hearing aid gain settings are determined. The hearing aid transfer function and transfer function of feedback path are also calculated from the closed loop transfer function measurements.

21 Claims, 3 Drawing Sheets

METHOD OF MEASURING AND PREVENTING UNSTABLE FEEDBACK IN HEARING AIDS

BACKGROUND OF THE INVENTION

1. Field of the Invention

This invention relates generally to the field of electronic hearing aids for improving the hearing of a human subject and, in particular, to a method for optimizing the gain of a hearing aid and preventing feedback instabilities.

2. Prior Art

Hearing aids are active electronic devices which detect sound with a miniature microphone, amplify and filter the sound with an electronic circuit, and deliver the amplified sound via a miniature loudspeaker called a "receiver." The amplified sound output of the receiver may be detected by the microphone, amplified by the circuit, and delivered again to the receiver, causing the process to be repeated. Thus, the sound energy is propagated in a "closed loop" from the hearing aid input, to the output, and back to the input. The path of the sound energy from the receiver to the microphone may either be acoustical or mechanical. Sound energy at some frequencies will add in phase as it travels around the closed loop. At these frequencies the energy builds up very rapidly, which saturates the hearing aid transducers and circuit and causes audible feedback, distortion, and general instability of the system.

These effects of unstable feedback render the hearing aid useless and produce an annoying howl or squealing sound that draws unwanted attention to the hearing aid user. The conditions which cause unstable feedback are well understood, and the means of preventing it are straightforward. The amplification or gain of the hearing aid can be reduced, or the tightness of the hearing aid fit in the ear canal can be increased. (The fit of the hearing aid in the ear canal and the use of small holes in the hearing aid shell for venting air pressure both determine the acoustic attenuation of the feedback path from the receiver to the microphone.) Both of these preventative measures have undesirable side effects, however. Too much reduction of hearing aid gain, or reductions at the wrong frequencies, may mean that the user will be unable to hear certain sounds. Likewise, tightening the fit of the hearing aid in the ear canal or blocking the vent may make the hearing aid uncomfortable to wear.

Heretofore, no simple and accurate methods have been available to the hearing aid dispenser for determining when unstable feedback will occur for a particular user and hearing aid, or what frequencies are causing the unstable feedback.

There are two principal prior art methods of preventing unstable feedback in hearing aids. The first method employs trial and error to adjust the hearing aid response. The dispenser observes that unstable feedback occurs with a particular hearing aid fitting and then either reduces the hearing aid gain or tightens the fit of the hearing aid in the ear canal. This process is repeated until unstable feedback no longer occurs. With such a trial and error process, dispensers are likely to make too large a gain adjustment. The consequences for the hearing aid user are too little gain and reduced hearing aid benefit.

The second method requires the use of a two-channel spectrum analyzer and the ability to break into the hearing aid circuit (e.g. at the output of the microphone ). This method is illustrated in FIG. 1. Hearing aid 10 comprises microphone 12, preamplifier 14, frequency dependent amplifier 16 and receiver (loudspeaker) 18. The hearing aid 10 is fitted in the user's ear canal. A test signal is generated by a spectrum analyzer 20, usually a wide bandwidth, flat spectrum audio noise signal, and provided as an input to the hearing aid amplifier in place of the microphone signal. This test signal is also delivered to the channel one input of the two-channel analyzer. The test signal is amplified by the hearing aid amplifier 16 and delivered to the receiver 18. The receiver output travels from B to A via the feedback path and is detected by the microphone 12. The output of the microphone preamplifier 14 is routed to the channel two input of the analyzer, and the open loop transfer function of the hearing aid in the ear canal is computed from the two channel inputs. From this transfer function, frequencies are identified at which the magnitude response is greater than or equal to unity and at which the wrapped phase response passes through 0°. In the closed loop system, which represents the actual hearing aid and feedback path, instability will occur at these frequencies because feedback will add in phase and cause sound energy to build up and saturate the system. The open loop magnitude response is adjusted by reducing the gain of the hearing aid at the unstable feedback frequencies so that the magnitude response is slightly less than unity.

There are substantial disadvantages to both of the above-disclosed prior art methods. This first method is a trial and error method that is prone to over-adjustments and misadjustments of hearing aid gain. This method is applied only after unstable feedback has been observed to occur. The dispenser does not know at which frequencies to make the gain adjustments, nor how large the adjustments should be. Over-adjustment of hearing aid gain to prevent unstable feedback can reduce the benefit of the hearing aid.

The disadvantages of the second method have mainly to do with its practicality. The method requires the hearing aid to be designed so that the internal signal path from the microphone to the amplifier can be interrupted for measurements with a two-channel spectrum analyzer. Special connectors must be mounted on the hearing aid to allow access to the signals. No known commercial hearing aids are designed in this fashion.

Feedback is a practical problem that can limit the performance and benefit of any hearing aid. Prior to the current invention, there have been no available methods for accurately predicting the frequencies and gains that will cause unstable feedback for a particular hearing aid response in a particular individual's ear. New digital hearing aid technologies are especially susceptible to feedback problems because of the additional delays introduced by digital processing in the hearing aid circuit.

SUMMARY OF THE INVENTION

The present invention provides a simple, efficient, robust, and "noninvasive" means of measuring whether a hearing aid, when placed in the ear of a user, will become unstable due to acoustic and mechanical feedback. The dispenser is able to use standard acoustic measurements with a probe microphone when the hearing aid is in the ear canal to accurately predict when a hearing aid fitting will cause unstable feedback and at what frequencies the unstable feedback will occur. These predictions can be made prior to prescribing hearing aid gain by use of a reference frequency response in the hearing aid. The measurements allow the dispenser to modify the desired hearing aid frequency response at only the frequencies that will cause unstable feedback. These modifications can be made before the desired response is set in the hearing aid. Thus, the invention provides a means of precisely specifying the changes in a hearing aid's magnitude and phase response at specific frequencies required to prevent unstable feedback. Consequently, the invention eliminates the trial and error method, and prevents over-adjustment of the hearing aid.

The present invention offers the following advantages over the prior art methods:

1. Does not require estimation of feedback frequencies and gains and possible over-correction of the hearing aid response.

2. Does not require breaking the circuit of hearing aid to measure open loop transfer function.

3. Does not require use of a spectrum analyzer or other costly and complex equipment.

4. Can be performed with typical clinical equipment such as probe microphone system and personal computer.

5. Identifies specific frequencies and gains which can cause unstable feedback.

6. Specifies the precise amount of gain reduction re: the hearing aid's current gain needed at feedback frequencies to prevent unstable feedback.

7. Specifies the precise amount of gain increase at any feedback frequency re: the hearing aid's current gain that can be introduced before unstable feedback occurs.

8. Allows the hearing aid dispenser to determine whether any arbitrary hearing aid gain response, other than the response used for the feedback measurements, will cause unstable feedback.

9. Allows the dispenser to determine the maximum hearing aid insertion gain that will cause unstable feedback.

10. Allows the dispenser to determine from measurements in a hearing aid coupler, e.g., a standard 2 $cm^3$ coupler, whether an arbitrary hearing aid gain response will cause unstable feedback.

11. Allows the dispenser to derive the hearing aid transfer function from probe microphone measurements of the closed loop transfer function.

12. Allows the dispenser to derive the transfer function of the feedback path from probe microphone measurements of the closed loop transfer function.

13. Allows the dispenser to derive the open loop transfer function of the hearing aid and feedback path system in the ear canal from probe microphone measurements of the closed loop transfer function.

14. Allows the dispenser to derive the transfer function of the forward leakage path of the hearing aid with the hearing aid in the ear canal from probe microphone measurements of the closed loop transfer function.

These and other advantages are achieved with a method and apparatus for determining the combined open loop transfer function of a hearing aid and feedback path in which a hearing aid is first fitted to a patient; a probe tube microphone is then inserted into the patient's ear canal through a vent in the hearing aid; a controlled acoustic signal is generated; an acoustic signal received at the probe tube microphone is measured at a plurality of hearing aid gains; a closed loop transfer function is calculated for each of the plurality of hearing aid gains; and the combined open loop transfer function of the hearing aid and feedback path is calculated as a function of the plurality of hearing aid gains and corresponding closed loop transfer functions.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

The method of the present invention involves a sequence of digital signal processing computations that are applied to digitized samples of acoustic signals. The methods, procedures, and instrumentation for detecting and digitizing these acoustic signals are described below. Also described are the computational methods that are applied to these signals to obtain information necessary for preventing unstable feedback in hearing aids.

Analytical Background

Figure 2:
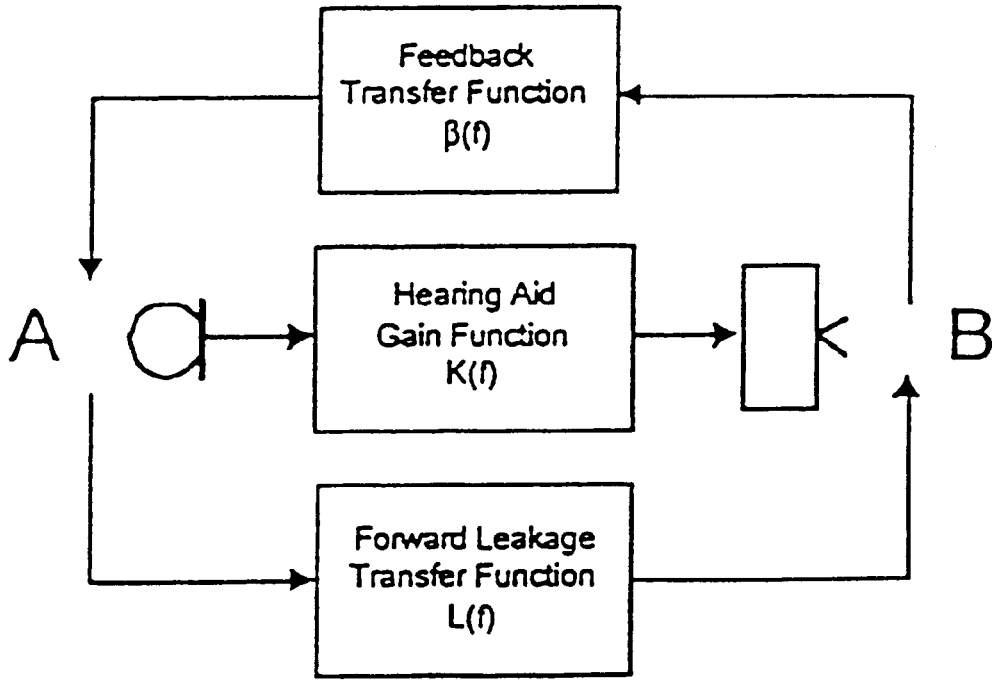
FIG. 2 illustrates the acoustic paths of a hearing aid fitted in the ear of a patient.

FIG. 2 shows the signal path of a hearing aid in the ear of a hearing aid user. Point A is at the position of the microphone input and point B is at the output of the receiver in the ear canal. The overall feedback path from B to A, i.e., from the receiver back to the microphone, includes several components: the acoustic leakage around the earmold, the acoustic leakage through the opening of the pressure vent (if any), and the mechanical coupling between the hearing aid receiver and the microphone through the rigid casing of the hearing aid. The forward acoustic path from A to B includes the path through the hearing aid and the forward leakage path. The forward leakage path is caused by leakage around the earmold and through the vent (if any).

The following symbols are used in FIG. 2. $\beta(f)$ is the feedback transfer function from point B to point A. $K(f)$ is the hearing aid transfer function from point A to point B, including the microphone, amplifiers and filters, and receiver. $L(f)$ is the forward leakage transfer function from point A to point B. It is assumed that the forward leakage signal does not contribute feedback to the hearing aid microphone, since $L(f)$ provides attenuation rather than gain in the forward path. In other words, the input to $\beta(f)$ is entirely from $K(f)$.

Figure 3:
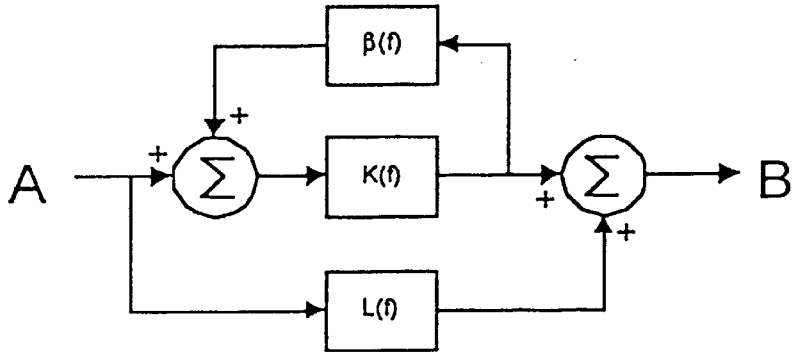
FIG. 3 illustrates the transfer function model of the acoustic paths shown in FIG. 2.

The signal paths shown in FIG. 2 can be redrawn as shown in FIG. 3. The closed loop transfer function from point A to point B of the hearing aid system with feedback and leakage paths is defined in Equation 1 below. Acoustic measurements of the hearing aid in the ear canal are of the closed loop transfer function, since the forward and backward signal paths are present.

$$H_{AB}(f) = \frac{K(f)}{1 - K(f)\beta(f)} + L(f) \quad (1)$$

Figure 1:
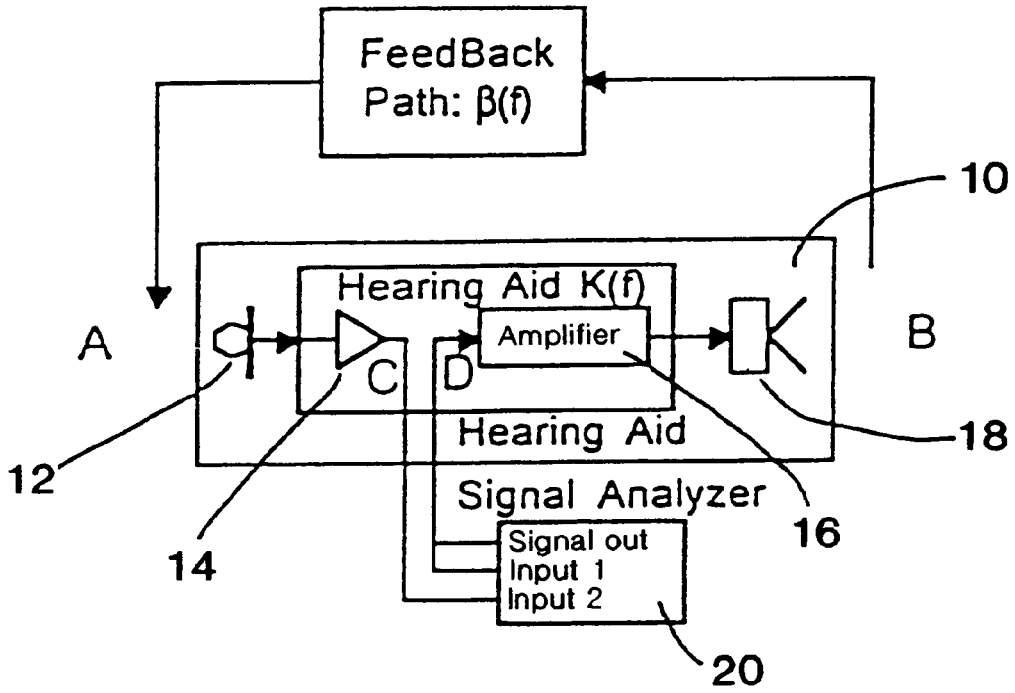
FIG. 1 (PRIOR ART)
FIG. 1 illustrates a prior art technique for preventing unstable feedback in a hearing aid.

K(f)β(f) is the open loop transfer function, which defines the combined magnitude and phase response of the hearing aid and feedback path. The open loop transfer function can only be measured directly by breaking the hearing aid circuit and taking a two-channel measurement from one side of the break to the other as described above in connection with FIG. 1.

Once the open loop transfer function is known, it is possible to compute precisely the potential feedback frequencies at which instabilities can occur. Instabilities can occur at only those frequencies where the open loop transfer function exhibits simultaneously the magnitude and phase characteristics given in Equation 2. These values for the open loop transfer function are referred to as "potential feedback frequencies."

$$|K(f)\beta(f)| \geqq 1$$

and $$\angle K(f)\beta(f) = n \times 360^\circ \quad (2)$$

where |K(f)b(f)| is the magnitude of the open loop transfer function, ∠K(f)b(f) is the phase angle of the open loop transfer function, and n is an integer. These equations show that the phase response of the open loop transfer function can be used to identify all and only those frequencies over the bandwidth of the hearing aid at which instabilities can occur. The hearing aid system will remain stable as long as the magnitude response at these frequencies is less than unity. Equation 3 states the stability conditions for each potential feedback frequency.

$$|K(f)\beta(f)| < 1 \quad (3)$$

or $$|K(f)| < \frac{1}{\beta(f)}$$

Thus, the maximum stable hearing aid gain at potential feedback frequencies is defined in Equation 4, where e is a small positive real number. In the inventors' experience, the smallest value of e that is practical is about 1 dB. Note that for all frequencies other than the potential feedback frequencies, the hearing aid will always be stable regardless of the gain.

$$K_{\max}(f) = \lim_{\varepsilon \to 0}\left[\frac{1}{\beta(f)} - \varepsilon\right] = \frac{1}{\beta(f)} \quad (4)$$

The current invention enables one to derive the open loop transfer function from multiple measurements of the closed loop transfer function. From the open loop transfer function, the potential feedbackfrequencies and the maximum stable gains at these frequencies are determined. These values are used to adjust the hearing aid gain at the potential feedback frequencies. Alternatively, the hearing aid phase response can be modified to shift the potential feedback frequencies. In addition, the current invention also enables one to compute the feedback transfer function and the hearing aid transfer function. These transfer functions can be used to compute the maximum stable hearing aid insertion gain, as well as other information used to fit hearing aids.

The methods and procedures for detecting and digitizing the acoustic signals used in the current invention are, in part, the subject of U.S. Pat. No. 5,325,436, "Method of Signal Processing for Maintaining Directional Hearing with Hearing Aids", the disclosure of which is incorporated herein by reference. These methods allow one to compute complex transfer functions from single-microphone recordings of an acoustic signal.

Instrumentation

Figure 4:
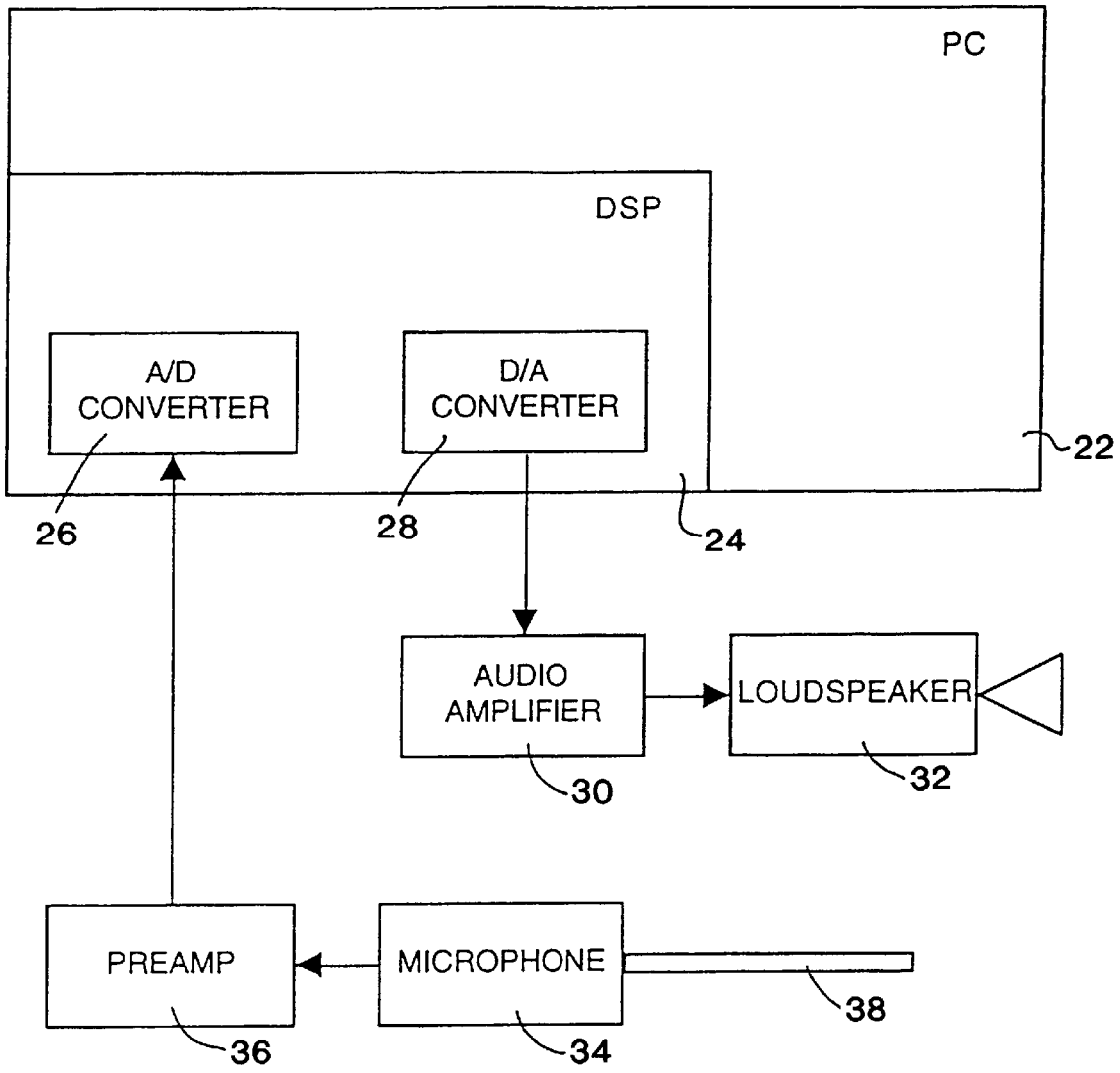
FIG. 4 is a block diagram of the instrumentation system used to practice the present invention.

FIG. 4 is a block diagram of the instrumentation system used to practice the present invention. The invention is implemented with a computerized system based on a conventional IBM-type personal computer (PC) 22. The system includes a probe tube microphone system, a PC plug-in digital signal processing (DSP) board 24 with analog-to-digital (A/D) 26 and digital-to-analog (D/A) 28 converters, a power amplifier 30 and a loudspeaker 32. The DSP board may be any one of several commercially available boards as long as it is capable of simultaneously sampling at its input and providing an audio signal at its output. The probe tube microphone system consists of a microphone 34, a preamplifier 36 and a silicone tube 38 for insertion through the hearing aid vent. The probe tube is used to acquire acoustic signals at the hearing aid receiver's output near the user's eardrum when the hearing aid is positioned in the ear canal.

The test signal is stored in the PC in a digital format. The test signal is a Gaussian-distributed white noise of 3 sec in duration sampled at 16,000 Hz. The DSP board receives the digital data corresponding to the test signal from the PC and converts these data into an analog test signal using the D/A converter on the DSP board. The analog test signal is amplified and routed to a loudspeaker to produce a wideband acoustic test signal in the sound field at a sound pressure level of 65 dB(A) 1 m from the loudspeaker. The acoustic test signal is sensed with the probe tube microphone positioned in the ear canal of the subject seated 1 m from the loudspeaker. The output of the probe tube microphone is amplified and routed to the A/D converter on the DSP board where it is sampled at 16,000 Hz and converted to digital data. These sampled data are transferred to the PC and stored in digital format. The A/D sampling of the probe microphone signal is initiated simultaneously with the D/A conversion of the test signal and continues synchronously until the last D/A conversion is completed.

Data Acquisition Procedure

The hearing aid is turned off and placed in the subject's ear, and the subject is seated in a test room facing the loudspeaker at a distance of 1 m. The probe tube is placed in the subject's ear canal 5 mm from the receiver output via the hearing aid vent, or, if the hearing aid is unvented, by inserting the probe tube between the ear canal and the exterior surface of the hearing aid. The subject is instructed to remain still during the signal acquisition. The following five steps comprise the data acquisition process:

1. The hearing aid is turned on and programmed with a known frequency response and gain, G1, that does not cause oscillation at any frequency. The test signal is generated by the PC and converted to an analog signal by the D/A converter on the DSP board, power amplified, and presented in the sound field through the loudspeaker at 65 dB(A). The acoustic signal at the receiver output is sensed by the probe microphone system, preamplified, routed to the A/D, and sampled by the DSP board simultaneously as the DSP board is also generating the test signal. The sampled signal with hearing aid gain G1 is stored in the PC for use in calculations.
2. The hearing aid gain is adjusted to another known gain, G2, that does not cause oscillation at any frequency. The difference between G1 and G2 is assumed to be the same at all frequencies over the hearing aid bandwidth. The same test signal is again presented in the sound field through the loudspeaker at 65 dB(A). The acoustic signal at the receiver output is again simultaneously acquired by the DSP board using the probe tube system. The sampled signal with hearing aid gain G2 is also stored in the PC for use in calculations.

3. The hearing aid is turned off or muted, i.e., G3=0. The same test signal is again presented in the sound field through the loudspeaker at 65 dB(A). The acoustic signal at the receiver output is simultaneously acquired by the DSP board using the probe tube system. The sampled signal with hearing aid gain G3 is also stored in the PC for use in calculations.
4. The probe tube is removed from the ear canal, and the opening of the probe tube is positioned near the microphone on the hearing aid. The hearing aid is turned off or muted. The same test signal is again presented in the sound field through the loudspeaker at 65 dB(A) The acoustic signal is simultaneously acquired using the probe tube system. The sampled reference signal is also stored in the PC for use in calculations. Alternatively, a reference microphone other than the probe microphone may be positioned near the hearing aid microphone for the reference signal data acquisition, as long as the reference microphone is small enough and does not interfere the hearing aid feedback path. Acquisition of the reference signal with this reference microphone may be performed without removing the probe microphone from the ear canal, either by using the preamplified signal from the reference microphone as the input to the A/D instead of the probe microphone signal, or by simultaneously sampling the probe microphone signal and the reference microphone signal with a two-channel AID converter system. The time savings with this alternative method of data acquisition may be advantageous.
5. The hearing aid is removed from the ear canal and the probe tube is positioned in the same spot in the ear canal as for the aided data acquisitions. The same test signal is again presented in the sound field through the loudspeaker at 65 dB(A), and the probe microphone signal is simultaneously acquired. The sampled unaided signal is also stored in the PC for use in maximum insertion gain calculations.

Computational Procedure

All of the computations described in the section are performed by the PC with software programs as part of a computerized fitting system. Each of the acquired probe microphone signals can be used in computations as if they were acquired simultaneously, since data acquisition is synchronized with the delivery of the same signal for each measurement. The reference signal and the three aided signals are used to compute three closed loop hearing aid transfer functions from point A to point B, as shown in FIG. 3.

Figure 5:
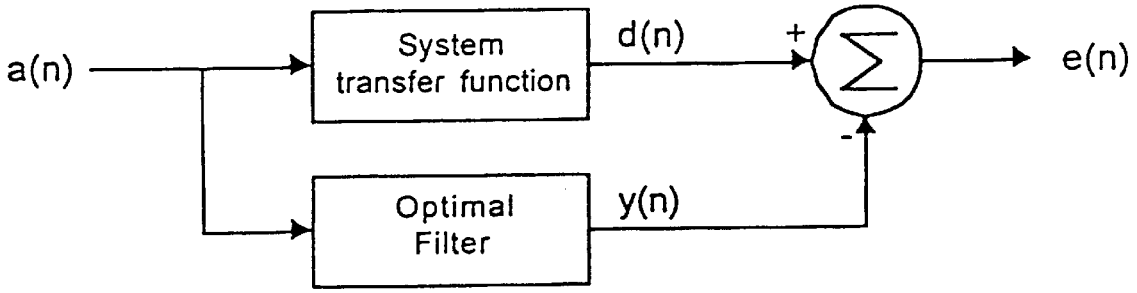
FIG. 5 illustrates the time domain Weiner optimal filter structure used to calculate transfer functions in accordance with the invention.

A time domain Weiner optimal filter structure is used for these calculations, as shown in FIG. 5. The magnitude and phase response of the optimal filter are such that, when the output filter y(n) is summed with output d(n) of the system transfer function, the error e(n) is minimized. Although there are other methods of system identification that could be used to calculate the closed loop transfer function from the acquired data, the Weiner optimal filter method has these advantages: a two channel data acquisition system is not required, the filter response is given as a set off finite impulse response filter coefficients, and the computational complexity is relatively low.

The reference signal and the aided signal with hearing aid gain G1 are used to compute the aided closed loop transfer function, $H_{1AB}(f)$, and the reference signal and the aided signal with hearing aid gain G2 are used to compute the second aided closed loop transfer function, $H_{2AB}(f)$. Likewise, the reference signal and the signal acquired with the hearing aid muted, G3=0, are used to compute the transfer function of the forward leakage path, $H_{3AB}(f)$. Finally, the reference signal and the signal acquired with the hearing aid removed from the ear canal are used to compute the unaided transfer function, $H_{A_un}(f)$. Equation 5 and Equation 6 give the closed loop transfer function equations for $H_{1AB}(f)$ and $H_{2AB}(f)$, and Equation 7 gives the equation for $H_{3AB}(f)$.

$$H_{1AB}(f) = \frac{G1 \times K(f)}{1 - G1 \times K(f)\beta(f)} + L(f) \tag{5}$$

$$H_{2AB}(f) = \frac{G2 \times K(f)}{1 - G2 \times K(f)\beta(f)} + L(f) \tag{6}$$

$$H_{3AB}(f) = L(f) \tag{7}$$

Equation 5 is solved for K(f), and the value thus obtained is substituted into Equation 6. This equation may now be solved for the feedback transfer function of the hearing aid, β(f), as shown in Equation 8.

$$\beta(f) = \frac{G1 \times H_{2AB}(f) - G2 \times H_{1AB}(f) + H_{3AB}(f) \times (G2 - G1)}{(G2 - G1) \times [H_{1AB}(f) - H_{3AB}(f)] \times [H_{2AB}(f) - H_{3AB}(f)]} \tag{8}$$

Similarly, the value of β(f) is substituted into Equation 5 and a solution is obtained for K(f), the transfer function of the hearing aid in the ear canal. Equation 9 gives the equation for the hearing aid transfer function obtained in this manner.

$$K(f) = \frac{(G1 - G2) \times [H_{1AB}(f) - H_{3AB}(f)] \times [H_{2AB}(f) - H_{3AB}(f)]}{G1 \times G2 \times [H_{1AB}(f) - H_{2AB}(f)]} \tag{9}$$

Finally, the open loop transfer function of the hearing aid and feedback path, K(f)/β(f), is obtained as shown in Equation 10.

$$K(f)\beta(f) = \frac{G1 \times H_{2AB}(f) - G2 \times H_{1AB}(f) + H_{3AB}(f) \times (G2 - G1)}{G2 \times G1 \times [H_{2AB}(f) - H_{1AB}(f)]} \tag{10}$$

Once the open loop transfer function is known, its phase response can be used to identify potential feedback frequencies at which feedback components will add in phase to produce instabilities. These frequencies will have a phase response which is an integer multiple of 360°. For each of these potential feedback frequencies, $f_u$, it is also possible to compute the maximum stable hearing aid gain, $K_{max}(f_u)$, as shown in Equation 11.

$$K_{\max}(f_u) = \lim_{\varepsilon\to 0}\left[\frac{1}{\beta(f_u)} - \varepsilon\right] = \lim_{\varepsilon\to 0}\left[\left|\frac{(G2-G1)\times[H_{1AB}(f_u)-H_{3AB}(f_u)]\times[H_{2AB}(f_u)-H_{3AB}(f_u)]}{G1\times H_{2AB}(f_u)-G2\times H_{1AB}(f_u)+H_{3AB}(f_u)\times(G2-G1)}\right| - \varepsilon\right] = \left|\frac{(G2-G1)\times[H_{1AB}(f_u)-H_{3AB}(f_u)]\times[H_{2AB}(f_u)-H_{3AB}(f_u)]}{G1\times H_{2AB}(f_u)-G2\times H_{1AB}(f_u)+H_{3AB}(f_u)\times(G2-G1)}\right| \quad (11)$$

Sometimes when a hearing aid is being fitted to an individual, it is necessary to increase the hearing aid gain over that of the current gain setting of the hearing aid, as a means of improving the benefit of the hearing aid. In these cases, the dispenser must know the amount of additional hearing aid gain that can be added to the current gain setting without producing unstable feedback at any of the feedback frequencies. In this situation, the dispenser may acquire the aided probe microphone data with gain settings G1 and G2. Both G1 and G2 are gains relative to the current gain setting. In the special case where G1=1, the current gain setting may be used for one of the probe microphone measurements The potential feedback frequencies can be computed according to the methods described above, and for any such frequency, $f_u$, the maximum additional hearing aid gain that can be applied to the current gain setting (i.e., the reference gain), $K_{add}(f_u)$, is defined in Equation 12. The values obtained from Equation 12 for $K_{add}(f_u)$ can be applied either to the hearing aid gain measured in situ or to the gain measured in a 2 $cm^3$ acoustic coupler, since $K_{add}(f_u)$ is an incremental value, not an absolute value.

$$K_{add}(f_u) = \frac{K_{\max}(f_u)}{|K(f_u)|} = \frac{1}{|K(f_u)\beta(f_u)|} = \left|\frac{G2\times G1\times[H_{2AB}(f_u)-H_{1AB}(f_u)]}{G1\times H_{2AB}(f_u)-G2\times H_{1AB}(f_u)+H_{3AB}(f_u)\times(G2-G1)}\right| \quad (12)$$

In the special case where the reference gain of the hearing aid is the response which equalizes the magnitude and phase insertion effects of the hearing aid in the ear canal, $K_{add}(f)$ in Equation 12 becomes the maximum insertion gain of the hearing aid that can be achieved without unstable feedback. The maximum achievable insertion gain of a hearing aid in an individual's ear is important information to a hearing aid dispenser, since this information determines the limits of useful amplification that can be provided by the hearing aid.

Once the open loop transfer function has been computed and the hearing aid transfer function, K(f), is known, it is possible to derive the open loop transfer function for any other hearing aid transfer function, H(f), by using Equation 13. The new open loop transfer function, H(f)β(f), can then be used to determine potentially unstable feedback frequencies and gains in the same manner as above.

$$H(f)\beta(f) = \frac{G1\times H_{2AB}(f)-G2\times H_{1AB}(f)+H_{3AB}(f)\times(G2-G1)}{G2\times G1\times[H_{2AB}(f)-H_{1AB}(f)]}\times\frac{H(f)}{K(f)} \quad (13)$$

Another specific application of the invention is to allow calculation of the maximum stable real ear insertion gain of a hearing aid. Real ear insertion gain is defined as the increase in sound pressure level at the eardrum with the hearing aid in place over the sound pressure level at the eardrum without the hearing aid. The real ear insertion gain is an important characteristic of a hearing aid, because it defines the actual gain the hearing aid user will experience with the hearing aid in place. To obtain the maximum stable real ear insertion gain, we define the closed loop transfer function from the microphone input (point A) to a point near the eardrum (point B), as shown in FIG. 3, in Equation 14. $H_{A_un}(f)$ is the transfer function from point A to point B without the hearing aid in place, i.e., the open ear transfer function. $H_{un_B}(f)$ is the transfer function from the unaided eardrum to the aided eardrum, i.e., the real ear insertion gain.

$$H_{AB}(f)=H_{A_un}(f)\times H_{un_B}(f)$$

or $$H_{AB}(f)=H_{A_un}(f)\times G_{insertion}(f) \quad (14)$$

The maximum real ear insertion gain, $|G_{max_insertion}(f)|$, is defined as the real ear insertion gain at which the hearing aid gain function is 1 dB less than the maximum stable gain at all potential feedback frequencies. A linear factor, a=0.981 is used for the 1 dB logarithmic unit. Under these conditions, the closed loop transfer function with respect to maximum real ear insertion gain, $|H_{max_AB}(f)|$, is given in Equation 15.

$$|H_{\max_AB}(f)| = \left|\frac{\alpha\times K_{\max}(f)}{1-\alpha\times K_{\max}(f)\beta(f)} + L(f)\right| = \left|\frac{\alpha\times K_{\max}(f)}{1-\alpha} + L(f)\right| = \left|\frac{\alpha}{1-\alpha}\times\frac{(G2\times G1)\times[H_{1AB}(f)-H_{3AB}(f)]\times[H_{2AB}(f)-H_{3AB}(f)]}{G1\times H_{2AB}(f)-G2\times H_{1AB}(f)+(G2-G1)\times H_{3AB}(f)} + H_{3AB}(f)\right| \quad (15)$$

Equation 15 may be used to find the maximum stable real ear insertion gain, $|G_{max_insertion}(f)|$. The formula for this computation is given in Equation 16.

$$|G_{\max_insertion}(f)| = \left|\frac{H_{\max_AB}(f)}{H_{A_un}(f)}\right| = \left|\frac{\frac{\alpha}{1-\alpha}\times\frac{(G2\times G1)\times[H_{1AB}(f)-H_{3AB}(f)]\times[H_{2AB}(f)-H_{3AB}(f)]}{G1\times H_{2AB}(f)-G2\times H_{1AB}(f)+(G2-G1)\times H_{3AB}(f)}+H_{3AB}(f)}{H_{A_un}(f)}\right| \quad (16)$$

Experimental Results

The invention has been tested with acoustic measurements on a KEMAR mannequin, so that verification of the invention by comparisons with other measures could be performed. Two different hearing aids were used on the KEMAR mannequin: a prototype digital hearing aid and a conventional commercial in-the-canal (ITC) hearing aid. The tests with the prototype hearing aid consisted of open loop transfer function measurements of the hearing aid with a conventional method in a reference condition, and measurements with the invention which allow the open loop transfer function to be derived from closed loop measurements. From the closed loop transfer function it is also possible to derive the transfer function of the hearing aid in the ear canal, i.e., its gain and frequency response, and the transfer function of the hearing aid feedback path.

When the open loop transfer function is known, the hearing aid gain and frequency response can be adjusted to prevent an unstable feedback condition from occurring. The open loop transfer function measurements were made with a two-channel spectrum analyzer using conventional methods by breaking the closed loop signal path in the hearing aid circuit. These reference measurements were compared to the measurements derived with the invention. The results of these comparisons confirmed that the invention accurately recovered the open loop transfer function, except at frequencies below 200 Hz where the coherence of the reference measurements was poor.

As a means of further evaluating the invention, the hearing aid gain was varied at frequencies predicted by the invention to cause acoustic feedback. These tests were performed with both the prototype hearing aid and the conventional hearing aid. Acoustic feedback occurred at hearing aid gains within 1.1 dB of the gains predicted by the invention. Deviations of this magnitude are within the acoustic measurement error of the instrumentation.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A method of adjusting the frequency response of a hearing aid to prevent unstable feedback comprising the steps of:

(a) fitting the hearing aid to a patient;

(b) inserting a probe tube microphone in the patient's ear canal;

(c) generating a controlled acoustic signal;

(d) measuring an acoustic signal received at the probe tube microphone at a plurality of hearing aid gains;

(e) calculating a closed loop transfer function for each of the plurality of hearing aid gains;

(f) calculating the combined open loop transfer function of the hearing aid and feedback path as a function of the plurality of hearing aid gains and corresponding closed loop transfer functions;

(g) analyzing the phase response of the combined open loop transfer function to identify frequencies at which unstable feedback can occur;

(h) computing a maximum stable gain for each of the frequencies identified in step (g); and (i) adjusting the frequency response of the hearing aid to have a gain less than the computed maximum stable gain at each of the frequencies identified in step (g).

2. The method of claim 1 wherein the step of generating a controlled acoustic signal comprises generating Gaussian-distributed white noise.

3. The method of claim 1 wherein the controlled acoustic signal is generated with a loudspeaker.

4. The method of claim 3 wherein the controlled acoustic signal has a sound pressure level of at least 65 dB(A).

5. The method of claim 1 wherein the step of calculating a closed loop transfer function comprises solving for a time domain Weiner optimal filter.

6. The method of claim 1 wherein the plurality of hearing aid gains comprises a gain of zero.

7. The method of claim 1 wherein the probe tube microphone is inserted through a vent in the hearing aid.

8. The method of claim 1 further comprising the step of computing a maximum additional hearing aid gain that can be applied to a current gain setting at the potentially unstable frequency.

9. The method of claim 1 further comprising the step of calculating a maximum stable real ear insertion gain.

10. The method of claim 9 wherein the maximum stable real ear insertion gain at the potentially unstable frequency is calculated to be approximately 1 dB below the maximum stable hearing aid gain.

11. A system for adjusting the frequency response of a hearing aid to prevent unstable feedback comprising:

(a) a probe tube microphone insertable in a patient's ear canal while the patient is fitted with the hearing aid;

(b) means for generating a controlled acoustic signal;

(c) means for measuring an acoustic signal received at the probe tube microphone at a plurality of hearing aid gains;

(d) means for calculating a closed loop transfer function for each of the plurality of hearing aid gains;

(e) means for calculating the combined open loop transfer function of the hearing aid and feedback path as a function of the plurality of hearing aid gains and corresponding closed loop transfer functions;

(f) means for analyzing the phase response of the combined open loop transfer function to identify frequencies at which unstable feedback can occur;

(g) means for computing a maximum stable gain for each of the identified frequencies at which unstable feedback can occur; and (h) means for adjusting the frequency response of the hearing aid to have a gain less than the computed maximum stable gain at each of the frequencies identified in step (f).

12. The system of claim 11 wherein the means for generating a controlled acoustic signal comprises a loudspeaker.

13. The system of claim 11 wherein the means for generating a controlled acoustic signal comprises a digital-to-analog converter coupled to a means for generating a digital signal corresponding to the acoustic signal.

14. The system of claim 13 wherein the means for generating a digital signal comprises a digital signal processor circuit.

15. The system of claim 14 wherein the digital signal processor circuit is a module installed in a personal computer.

16. The system of claim 13 wherein the means for generating a controlled acoustic signal further comprises an audio amplifier.

17. The system of claim 11 wherein the means for measuring an acoustic signal at the probe tube microphone comprises an analog-to-digital converter coupled to the probe tube microphone.

18. The system of claim 17 wherein the analog-to-digital converter is contained in a digital signal processor circuit board.

19. The system of claim 18 wherein the digital signal processor circuit board is a module installed in a personal computer.

20. The system of claim 11 wherein the means for calculating a closed loop transfer function comprises a personal computer.

21. The system of claim 11 wherein the means for calculating the combined open loop transfer function of the hearing aid and feedback path comprises a personal computer.

* * * * *